US005938384A

United States Patent [19]

Pratt

[11] Patent Number: 5,938,384

[45] Date of Patent: Aug. 17, 1999

[54] FASTENER SYSTEM

[75] Inventor: John D. Pratt, Laguna Niguel, Calif.

[73] Assignee: Textron Inc., Providence, R.I.

[21] Appl. No.: 09/020,209

[22] Filed: Feb. 6, 1998

Related U.S. Application Data

[63] Continuation-in-part of application No. 08/614,741, Mar. 13, 1996, and a continuation-in-part of application No. 08/703,012, Aug. 26, 1996.

[51] Int. Cl.[6] ..... F16B 13/06; F16B 43/00

[52] U.S. Cl. ..... 411/55; 411/60; 411/533; 36/67 D

[58] Field of Search ..... 411/24, 55, 60, 411/61, 271, 531, 533; 36/67 A, 67 B, 67 D

[56] References Cited

U.S. PATENT DOCUMENTS

| | | | |
|---|---|---|---|
| 705,571 | 7/1902 | Ferguson . | |
| 2,207,476 | 7/1940 | Bernstein . | |
| 2,331,555 | 10/1943 | Jostich, Jr. et al. . | |
| 3,042,094 | 7/1962 | Liljeberg . | |
| 3,101,763 | 8/1963 | McGehee | 411/531 X |
| 3,175,455 | 3/1965 | Reddy . | |
| 3,348,596 | 10/1967 | Leitner . | |
| 3,603,626 | 9/1971 | Whiteside . | |
| 3,837,522 | 9/1974 | Lesnansky, Jr. | 411/271 X |
| 4,004,486 | 1/1977 | Schenk . | |
| 4,354,322 | 10/1982 | Carone | 411/24 X |
| 4,474,515 | 10/1984 | Pitzer . | |
| 4,623,277 | 11/1986 | Wayne et al. . | |
| 4,753,559 | 6/1988 | Pentesco . | |
| 5,190,393 | 3/1993 | Svensson . | |
| 5,391,023 | 2/1995 | Basteck | 411/55 |
| 5,474,403 | 12/1995 | Hetrich . | |
| 5,486,079 | 1/1996 | Martin et al. . | |

FOREIGN PATENT DOCUMENTS

| | | | |
|---|---|---|---|
| 999794 | 2/1952 | France | 411/55 |
| 624049 | 5/1949 | United Kingdom . | |
| 1428797 | 3/1976 | United Kingdom . | |
| 2245326 | 1/1992 | United Kingdom . | |

*Primary Examiner*—Neill Wilson

*Attorney, Agent, or Firm*—Trexler, Bushnell, Giangiorgi & Blackstone, Ltd.

[57] ABSTRACT

Disclosed is a fastener system which includes a shaft having expander retaining structure and a threaded portion thereon. An expander is configured for disposition and engagement in a receptacle at least partially defined by a surface. The expander has a bore defined by a wall, and has an end for receiving at least the threaded portion of the shaft. At least a portion of the wall of the expander is threaded for receiving the threaded portion of the shaft. The expander retaining structure on the shaft retains the expander thereon when the threaded portion of the shaft is received by the expander. Expander actuating structure is provided on at least one of the shaft and the expander causing the expander to engage with the surface defining the receptacle.

11 Claims, 2 Drawing Sheets

FASTENER SYSTEM

CROSS-REFERENCE

The present application is a Continuation-in-Part application of U.S. patent application Ser. No. 08/614,741 entitled "Quick Release Fastener with Expandable Nut Body", filed Mar. 13, 1996 and U.S. patent application Ser. No. 08/703,012 entitled "Fastener System with Expandable Nut Body", filed Aug. 26, 1996.

BACKGROUND

The present invention relates generally to fastener systems which can be used to fasten a traction element, such as a spike, to the undersole of a shoe, and especially to the undersole of an athletic shoe. More specifically, the present relates to a novel fastener system which can be used to provide a traction element, such as a spike, which is easy to assemble and fasten to the undersole of an athletic shoe, and which resists accidental disassembly therefrom after being so fastened.

Some fastener systems presently used to fasten traction elements, such as spikes, on athletic shoes consist of several small components. As a result, it is sometimes difficult to accurately position the components during assembly, and it is possible that one or more components may get lost during assembly.

Moreover, some fastener systems used in connection with traction elements do not have an aesthetically pleasing appearance once assembled onto the undersole of an athletic shoe. Additionally, many fastener systems used to fasten traction elements on the undersole of an athletic shoe are prone to accidental disassembly therefrom when the athletic shoe is worn.

A fastener system is disclosed in U.S. patent application Ser. No. 08/614,741 entitled "Fastener System with Expandable Nut Body", filed Mar. 13, 1996. The fastener system disclosed therein is comprised of relatively few components which are easy to assemble. The fastener system generally provides a fastener which, once fastened in a bore, cannot be accidentally unfastened therefrom. Specifically, the fastener system disclosed in the above-identified patent application includes a nut body which is insertable into a bore. When the nut body receives the fastener, the nut body expands in the bore, and the fastener and nut body becomes secured in the bore. However, there is no structure provided for retaining the nut body on the fastener. As a result, the nut body may become inadvertently disengaged from the fastener.

The present invention is directed to overcome the problems encountered heretofore.

OBJECTS AND SUMMARY

A general object of the present invention is to provide a fastener system consisting of relatively few components.

Another object of the present invention is to provide a fastener system which is easy to assemble.

Still another object of the present invention is to provide a fastener system which resists accidental disassembly.

A still further object of the present invention is to provide a fastener system which can be used to retain a traction element on the undersole of an athletic shoe.

Briefly, and in accordance with the above, the present invention envisions a fastener system which includes a shaft having expander retaining structure and a threaded portion thereon. An expander is configured for disposition and engagement in a receptacle at least partially defined by a surface. The expander has a bore defined by a wall, and has an end for receiving at least the threaded portion of the shaft. At least a portion of the wall of the expander is threaded for receiving the threaded portion of the shaft. The expander retaining structure on the shaft retains the expander thereon when the threaded portion of the shaft is received by the expander. Expander actuating structure is provided on at least one of the shaft and the expander causing the expander to engage with the surface defining the receptacle.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which.

DESCRIPTION

Figure 1:
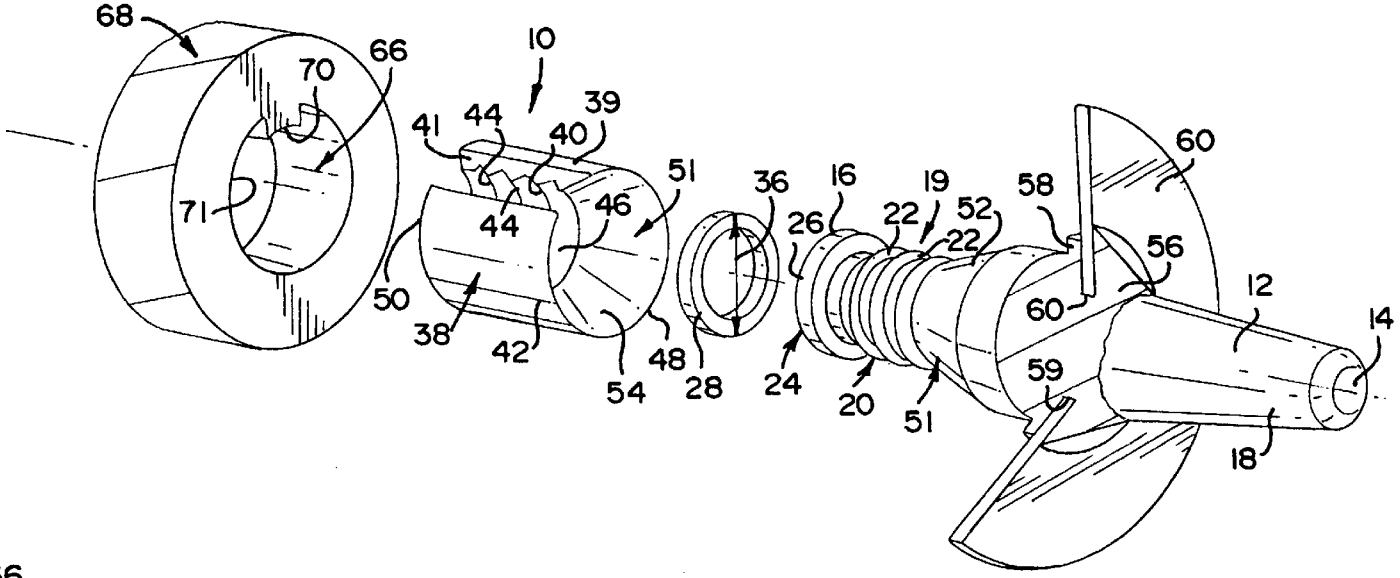
FIG. 1 is an enlarged, exploded perspective view of a fastener system in accordance with a first embodiment of the present invention.

While the present invention may be susceptible to embodiment in different forms, there is shown in the drawings, and herein will be described in detail, several embodiments with the understanding that the present description is to be considered an exemplification of the principles of the invention and is not intended to limit the invention to that as illustrated and described herein.

Figure 2:
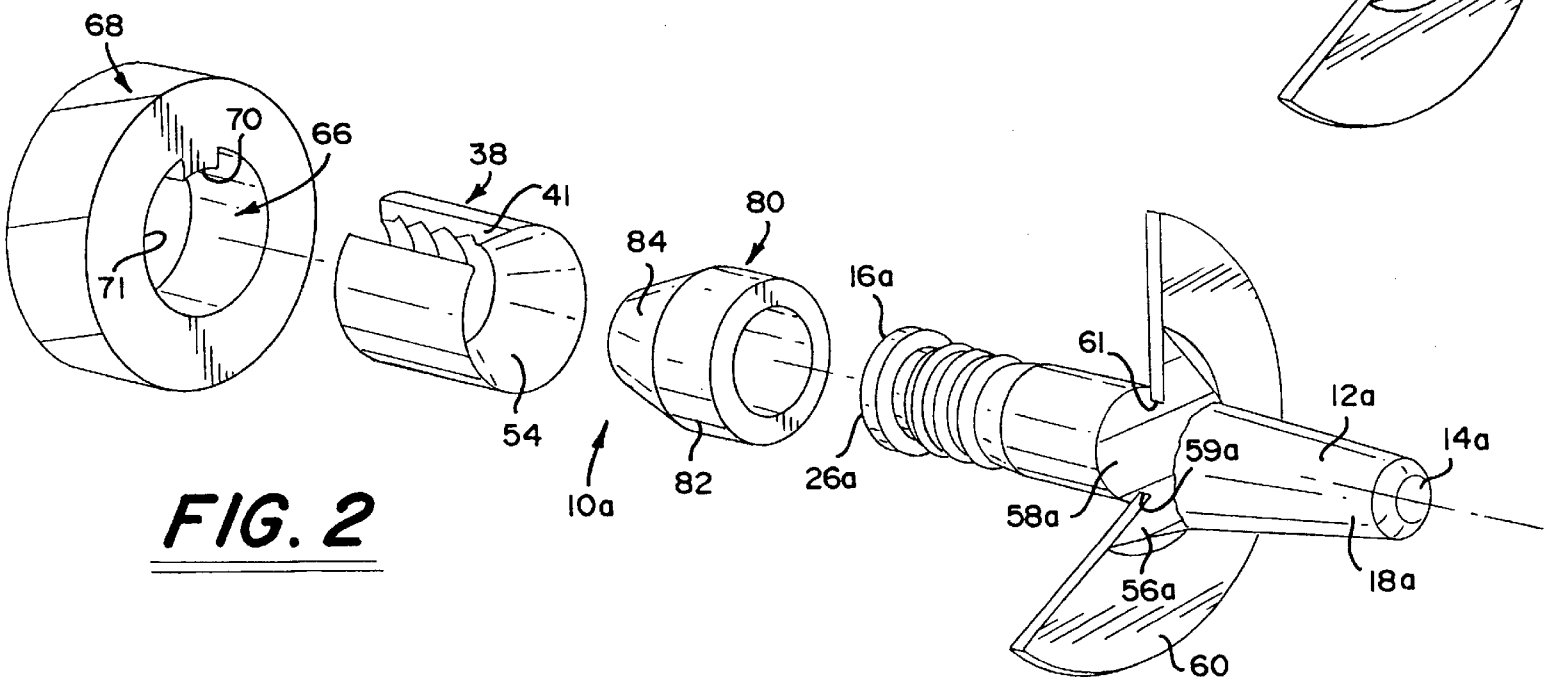
FIG. 2 is an enlarged, exploded perspective view of a fastener system in accordance with a second embodiment of the present invention.
Figure 3:
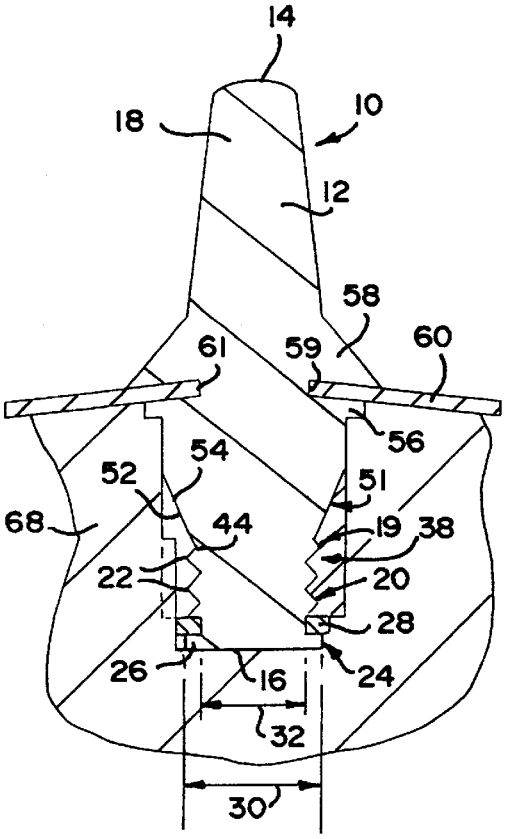
FIG. 3 is a cross-sectional view of the fastener system of FIG. 1 shown assembled and engaged in a receptacle in a workpiece.
Figure 4:
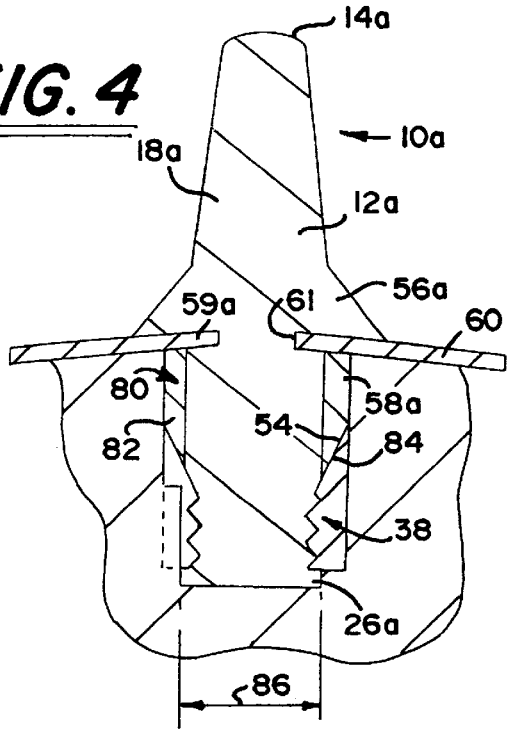
FIG. 4 is a cross-sectional view of the fastener system of FIG. 2 shown assembled and engaged in a receptacle in a workpiece.
Figure 5:
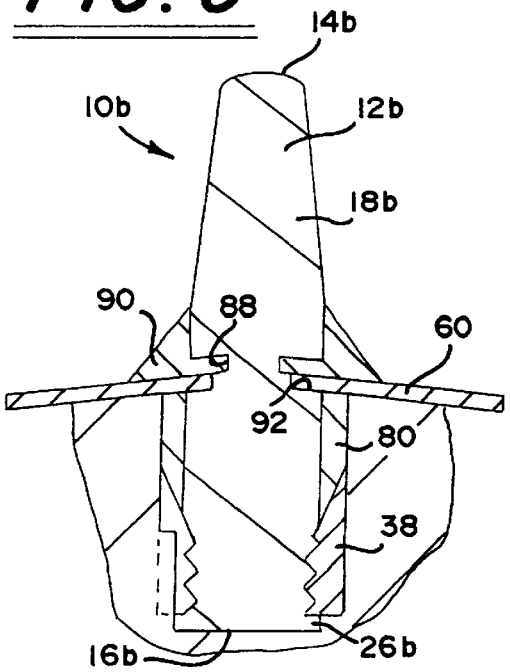
FIG. 5 is a cross-sectional view of a fastener system in accordance with a third embodiment of the present invention shown assembled and engaged in a receptacle in a workpiece.
Figure 6:
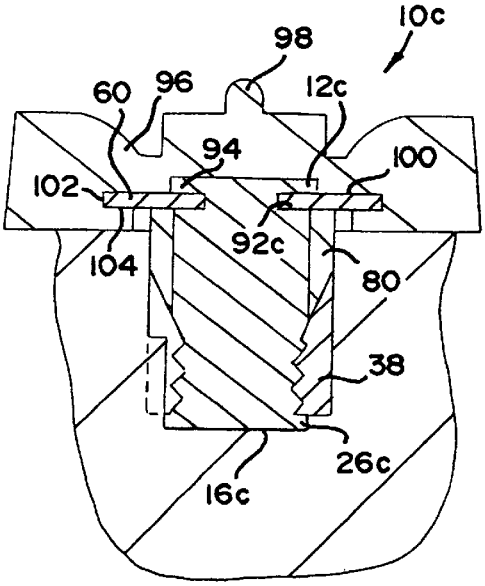
FIG. 6 is a cross-sectional view of a fastener system in accordance with a fourth embodiment of the present invention shown assembled and engaged in a receptacle in a workpiece.

Shown in the drawings are several fastener systems, each in accordance with one or more aspects of the present invention. Specifically, shown in FIGS. 1 and 3 is a fastener system 10 in accordance with a first embodiment of the present invention, shown in FIGS. 2 and 4 is a fastener system 10*a* in accordance with a second embodiment of the present invention, shown in FIG. 5 is a fastener system 10*b* in accordance with a third embodiment of the present invention, and shown in FIG. 6 is a fastener system 10*c* in accordance with a fourth embodiment of the present invention. Each of the fastener systems is in the form of a cleat; however, the present invention may take other forms.

The fastener system 10 shown in FIGS. 1 and 3 includes a stud 12 having a first end 14 and an opposing, second end 16. At the first end 14 is an extending portion 18. Preferably, the extending portion 18 is shaped such that it provides traction with a ground when the fastener system 10 is secured to the undersole of a shoe, and the shoe is worn and the undersole engaged with the ground. Engagement of the fastener system 10 with a workpiece, such as with the undersole of a shoe, will be described later herein. To provide the traction desired, the extending portion 18 may be provided as being shaped in one of many different configurations. As shown, the extending portion 18 may be conically-shaped. Other shapes which can be used include a "stepped Christmas tree" or a flat member having teeth thereon.

The stud 12 of the fastener system 10 includes a shaft portion 19 which forms a threaded portion 20, and the threaded portion 20 is formed of threads 22 on the stud 12. On the stud 12 is expander retaining structure 24. As shown, the expander retaining structure 24 may comprise a head 26 at the end 16 of the stud 12 where the head 26 is located immediately adjacent the threaded portion 20 of the stud 12, and may further comprise a retainer 28 on the stud 12, adjacent the head 26. The retainer 28 is preferably a washer. The head 26 has a diameter 30 greater than an inside diameter 32 of the retainer 28. This provides that the retainer 28 cannot readily slide past the head 26.

The threaded portion 20 of the stud 12 receives an expander 38 thereon. Preferably, the expander 38 is like that which is disclosed in U.S. patent application Ser. No. 08/614,741 entitled "Fastener System with Expandable Nut Body", filed Mar. 13, 1996, which is incorporated herein, in its entirety, by reference. As shown, the expander 38 is preferably provided in the form of an expandable nut body. Specifically, the expander 38 is preferably a nut body having a single wall configuration 39 where the wall 39 has an internal wall surface 40 and an external wall surface 42. As shown, a slot 41 is formed in the expander 38. The slot 41 provides that the expander 38 can expand, and provides that the expander 38 can engage a key in a workpiece. This will be described more fully later herein. The internal wall surface 40 of the expander 38 has threads 44 formed thereon, and defines a threaded bore 46 through the expander 38. The expander 38 has a first end 48 and an opposite, second end 50. The first end 48 receives the stud 12, and more specifically, threadably receives the threaded portion 20 thereof in the threaded bore 46. As a result, the expander 38 is threadably received on the stud 12.

As mentioned, the head 26 has a diameter 30 greater than an inside diameter 32 of the retainer 28 and this provides that the retainer 28 cannot readily slide past the head 26. Additionally, the retainer 28 has an outside diameter 36 which is greater than a diameter of the threaded portion 20 of the stud 12. Therefore, when the expander 38 is fully threadably received on the stud 12, the end 50 of the expander 34 contacts the retainer 28 and secures the retainer 28 against the head 26 of the stud 12. This contact between the expander 38, the retainer 28 and the head 26 of the stud 12 works to retain the expander 38 on the stud 12. Specifically, the head 26 prevents the retainer 28 from sliding therepast, and the retainer 28 prevents the expander 38 from being rotated along the stud 12 past the retainer 28 and ultimately out of threadable engagement with the stud 12.

Preferably, provided on the stud 12 and the expander 38 are expander actuating structures 51. Expander actuating structure 51 on the stud 12 includes a ramp 52 adjacent the threaded portion 20 of the stud 12. It is preferred that the ramp 52 be provided as being an integral and unitary portion of the stud 12. In other words, the stud 12 is shaped in such a manner as to provide the ramp 52. When the expander 38 is threadably retained on the threaded portion 20 of the stud 12, the ramp 52 is located adjacent the end 48 of the expander 38. Expander actuating structure 51 on the expander 38 includes an inclined surface portion 54 at the end 48 of the expander 38. When the ramp 52 and the inclined surface portion 54 of the expander 38 are in initial contact with each other, any further threading of the stud 12 into the expander 38 causes the ramp 52 on the stud 12 to press against the inclined surface portion 54 of the expander 38 thereby causing the expander 38 to spread. This will be described more fully later herein.

While it is preferred that expander actuating structure 51 be provided on both the expander 38 and the stud 12, it is possible that expander actuating structure 51 be provided only on one of the expander 38 and the stud 12. For example, the inclined surface portion 54 at the end 48 of the expander 38 may be omitted such that the end 48 of the expander 38 is instead formed to a flat, noninclined surface. In this case, the expander 38 would still urge up the ramp 52 on the stud 12 upon threading the stud 12 into the expander 38 causing the expander 38 to expand. Likewise, the ramp 52 on the stud 12 may be omitted and only the inclined surface portion 54 at the end 48 of the expander 38 may be provided. In this case, a flat surface replacing the ramp 52 on the stud 12 would still press against the inclined surface portion 54 at the end 48 of the expander 38 and urge the expander 38 to expand.

The stud 12 also includes an outwardly extending flange 60 or skirt. The flange 60 may be integral with the stud 12 such that the flange 60 is actually a portion of the stud 12. Alternatively, as shown, the flange 60 may comprise a separate piece with is secured to the stud 12. To this end, the stud 12 includes two outwardly extending stakes 56 and 58 or annular protrusions. The stakes 56 and 58 retain the outwardly extending flange 60 or skirt therebetween in an annular recess 59. The flange 60 has a central aperture 61 through which the stud 12 is received. The flange 60 is preferably provided in a frusto-conical shape having a central aperture 61 which receives the stud 12. This shape of the flange 60 provides that the flange 60, when retained on the stud 12, extends towards the end 16 of the stud 12, angled relative to the longitudinal axis of the stud 12.

To better retain the flange 60, the top stake 56 is preferably also provided at an angle relative to the longitudinal axis of the stud 12. Not only does the angled stake 56 provide for improved retainment of the flange 60, but the angled stake 56 also provides for a more aesthetic appearance when the fastener system 10 is secured to a workpiece. The angle of the flange 60 provides that the flange 60 presses on the workpiece, such as on the undersole of a shoe, when the fastener system 10 is retained in a receptacle thereon. This will be described more fully later herein. Of course, instead of providing that the stake 56 is angled, it is possible to provide that the stake 56 is not angled and merely forms a shoulder extending from the stud 12 for retaining the flange 60.

Preferably, the stud 12, flange 60, expander 38 and retainer 28 are formed of metal. However, any or all of these components may be formed of a different suitable material.

Now that the different components of the fastener system 10 have been described, assembly of the fastener system 10 and subsequent securement in a receptacle in a workpiece 68 will be described. As mentioned, the workpiece 68 may be the undersole of an athletic shoe.

Initially, the fastener system 10 is assembled. To assemble the fastener system 10, first the flange 60 is secured on the stud 12. This is performed by inserting the end 16 of the stud 12 into the central aperture 61 of the flange 60. At this time, the head 26 at the end 16 of the stud 12 is not yet formed. The flange 60 is brought past the stake 58 such that the flange 60 becomes secured in the annular recess 59 between the stakes 56 and 58.

Alternatively, the stud 12 may be fed into a punch press die. Then, a sheet of metal may be punched to form an aperture 61 therein, and the stud 12 inserted through the aperture 61 such that the sheet of metal becomes secured in the annular recess 59 between the stakes 56 and 58 on the stud 12. Then, the sheet of metal can be cut to shape the flange 60 around the stud 12.

After the flange 60 is secured on the stud 12, the expander 38 is threadably engaged with threaded portion 20 of the stud 12. Specifically, the end 16 of the stud 12 is inserted into the end 48 of the expander 38 and rotation is effected between the expander 38 and stud 12 to cause the expander 38 to threadably engage with the threaded portion 20 of the stud 12. Preferably, the expander 38 is threaded onto the stud 12 such that the inclined surface portion 54 of the expander 38 becomes positioned directly adjacent the ramp 52 on the stud 12.

After the expander 38 is so positioned on the stud 12, the retainer 28 is passed over the end 16 of the stud 12 such that the retainer 28 contacts the expander 38. Finally, the end 16 of the stud 12 is punched or crimped to create the head 26 thereon. The head 26 at the end 16 of the stud 12 secures the retainer 28 and the expander 38 on the shaft portion 19 of the stud 12.

Subsequently, the assembled fastener system 10 can be secured to a workpiece 68, and more specifically, can be secured in a receptacle 66 in a workpiece. To do so, the assembled fastener system 10 including the expander 38 and retainer 28 secured on the stud 12 is inserted into the receptacle 66 in the workpiece 68. More specifically, the end 16 of the stud 12 is inserted into the receptacle 66 such that a key 70 formed on the surface 71 defining the receptacle 66 compliments and engages the slot 41 in the expander 38. At this time the flange 60 contacts the workpiece 68. Subsequently, the stud 12 is rotated relative to the workpiece 68. To facilitate the rotation of the stud 12, holes and/or grooves may be provided in the flange 60 for engaging the tool therewith as is readily known in the art.

When the stud 12 is rotated relative to the workpiece 68, the key 70 in the receptacle 66 retains the slot 41 in the expander 38 thereby holding the expander 38 in place. Therefore, the stud 12 rotates relative to the expander 38 and threads further into the threaded bore 46 of the expander 38. This further threading of the stud 12 into the expander 38 causes the ramp 52 on the stud 12 to press against the inclined surface portion 54 of the expander 38. This pressing causes the expander 38 to expand (the slot 41 becomes wider) into engagement with the surface 71 forming the receptacle 66 in the workpiece 68. The engagement between the expander 38 and the surface 71 of the receptacle 66 provides that the fastener system 10 is frictionally secured to the workpiece 68 and resists accidental disassembly therefrom. At this time, the flange 60 presses on the workpiece 68 tending to urge the fastener system 10 out of the receptacle 66. Specifically, the flange 60 biases the stud 12 axially out of the receptacle 66. This contacting of the flange 60 against the workpiece 68 and the urging of the stud 12 out of the receptacle 68 by the flange 60 prevents over-rotation of the stud 12 into the receptacle 66.

The fastener system 10 is comprised of very few components. Additionally, as the fastener system 10 is secured to the workpiece 68 in the manner described, the head 26 on the end 16 of the stud 12 keeps the expander 38 and retainer 28 retained on the shaft portion 19 of the stud 12. In fact, the head 26 keeps the expander 38 and retainer 28 retained on the shaft portion 19 of the stud 12 even when the fastener assembly 10 is not engaged with the workpiece 68. Additionally, the flange 60 is kept securably retained on the stud 12. Therefore, the fastener assembly 10 is not only comprised of very few components, but the components are provided as an integral assembly which does not readily disassemble. Still further, the fastener system 10 provides for quick and easy securement to a workpiece 68 where essentially one merely needs to insert an expander 38 of the fastener system 10 into a receptacle 66 and give the stud 12 of the fastener system 10 a quarter-turn. Once secured to the workpiece 68, the fastener system 10 resists accidental release therefrom.

The fastener system 10*a* shown in FIGS. 2 and 4 will now be described. Because the fastener system 10*a* shown in FIGS. 2 and 4 is very similar to the fastener system 10 just described, identical reference numerals are used to identify identical parts, and detailed description thereof is omitted with the understanding that one can refer to the description of fastener system 10 to obtain an understanding of the corresponding part of fastener system 10*a*. Additionally, where parts of the fastener system 10*a* are very similar to certain parts of fastener system 10, identical reference numerals are used with the alphabetic suffix "a" added.

Like fastener system 10, fastener system 10*a* shown in FIGS. 2 and 4 includes a stud 12*a* having a head 26*a* at one end 16*a* and an extending portion 18 at the other end 14*a*. Secured to the stud 12*a* is a flange 60, and the flange 60 is secured thereto by stake 56*a* and shoulder 58*a*. Much like the stakes 56 and 58 of fastener system 10, stake 56*a* of fastener system 10*a* is an annular protrusion. Preferably, stake 56*a* is angled in much the same manner as stake 56 of fastener system 10. In threaded engagement with a threaded portion 20*a* of the stud 12*a* is an expander 38 having a slot 41 therein, and the expander 38 is retained on the stud 12*a* by the head 26*a* at the end 16*a* thereof.

A difference between the fastener system 10*a* shown in FIGS. 2 and 4 and the fastener system 10 shown in FIGS. 1 and 3 and which has already been described resides in the fact that fastener system 10*a* includes an expander actuating member 80 between the expander 38 and the flange 60 where the expander actuating member 80 is a separate part and is not integral or unitary with the stud 12*a*. The expander actuating member 80 is preferably a ring 82 which includes an inclined surface 84 adjacent the inclined surface portion 54 of the expander 38.

Another difference between the fastener system 10*a* shown in FIGS. 2 and 4 and the fastener system 10 shown in FIGS. 1 and 3 is that no retainer 28 is included between the expander 38 and the head 26*a* at the end 16*a* of the stud 12*a*. Therefore, it is important that the diameter 86 of the head 26*a* of stud 12*a* be greater than an inside diameter of the expander 38 so that the head 26*a* can retain the expander 38 on the stud 12*a*.

Assembly of the fastener system 10*a* shown in FIGS. 2 and 4 and the securement of the assembled fastener system 10*a* to a workpiece 68 will now be described. To assemble the fastener system 10*a*, first the flange 60 is secured on the stud 12*a*. Like fastener system 10, this is performed by inserting the end 16*a* of the stud 12*a* into a central aperture 61 of the flange 60. At this time, the head 26*a* at the end 16*a* of the stud 12*a* is not yet formed. The flange 60 is brought past the shoulder 58*a* such that the flange 60 becomes secured in the annular recess 59*a* between the stake 56*a* and shoulder 58*a*.

Alternatively, the stud 12*a* may be fed into a punch press die and inserted through an aperture formed in sheet metal in much the same manner as described above in relation to fastener system 10.

After the flange 60 is secured on the stud 12, the expander actuating member 80 is slipped past the end 16*a* of the stud 12*a* into contact with, or at least to a position adjacent, the flange 60. Then, the expander 38 is threadably engaged with the threaded portion 20*a* of the stud 12. Preferably, the expander 38 is threaded onto the stud 12*a* until it initially contacts the expander actuating member 80. At this time, the inclined surface 84 of the expander actuating member 80 initially contacts the inclined surface portion 54 of the expander 38.

After the expander actuating member 80 and expander 38 are engaged with the stud 12*a*, the head 26*a* of the stud 12*a* is formed in much the same manner as described above in relation to fastener system 10. The head 26*a* at the end 16*a* of the stud 12*a* secures the expander actuating member 80 and expander 38 on the stud 12*a*.

Subsequently, the assembled fastener system 10*a* can be secured to a workpiece 68, and more specifically, can be secured in a receptacle 66 in a workpiece such as to the undersole of an athletic shoe. To do so, a portion of the assembled fastener system 10*a* is inserted into the receptacle 66 in the workpiece 68. More specifically, the end 16*a* of the stud 12*a* is inserted into the receptacle 66 such that a key 70 formed on the surface 71 defining the receptacle 66 compliments and engages the slot 41 in the expander 38. At this time the flange 60 contacts the workpiece 68. Subsequently, the stud 12*a* is rotated relative to the workpiece 68.

When the stud 12*a* is rotated relative to the workpiece 68, the key 70 in the receptacle 66 retains the slot 41 in the expander 38 thereby holding the expander 38 in place. Therefore, the stud 12*a* rotates relative to the expander 38 and threads further into the expander 38. This further threading of the stud 12*a* into the expander 38 causes the flange 60 to press the expander actuating member 80 into the expander 38. More specifically, the inclined surface 84 of the expander actuating member 80 presses against the inclined surface portion 54 of the expander 38. This causes the expander 38 to expand, in much the same manner as described above, and frictionally engage with the surface 71 which forms the receptacle 66 in the workpiece 68. The engagement between the expander 38 and the surface 71 of the receptacle 66 provides that the fastener system is frictionally secured to the workpiece 68 and resists accidental disassembly therefrom. At this time, the flange 60 presses on the workpiece 68 tending to urge the fastener system 10 out of the receptacle 66. Specifically, the flange 60 biases the stud 12*a* axially out of the receptacle 66. This contacting of the flange 60 against the workpiece 68 and the urging of the stud 12*a* out of the receptacle 68 by the flange 60 prevents over-rotation of the stud 12*a* into the receptacle 66.

Like fastener system 10, fastener system 10*a* is comprised of very few components. Also, the few components included are provided as an integral assembly which does not readily disassemble. Still further, the fastener system 10*a* provides for quick and easy securement to a workpiece 68 where essentially one merely needs to insert an expander 38 of the fastener system 10 into a receptacle 66 and give the stud 12*a* of the fastener system 10 a slight turn. Once secured to the workpiece 68, the fastener system 10 resists accidental release therefrom.

The fastener system 10*b* shown in FIG. 5 is very much like that of fastener system 10*a* shown in FIGS. 2 and 4 and just described. Therefore, identical reference numerals are used to identify identical parts, and detailed description thereof is omitted with the understanding that one can refer to the decription of fastener system 10*a* and fastener system 10 to obtain an understanding of the corresponding part of fastener system 10*b*. Additionally, where parts of the fastener system 10*b* are very similar to certain parts of fastener system 10*a* and fastener system 10, identical reference numerals are used with the alphabetic suffix "b" added.

As mentioned, the fastener system 10*b* shown in FIG. 5 is very similar to the fastener system 10 shown in FIGS. 2 and 4 and just described. In fact, the fastener system 10*b* also includes a stud 12*b* having an extending portion 18*b* at one end 14*b* of the stud 12*b* and a head 26*b* at the other end 16*b*. Additionally, an expander 38 and expander actuating member 80 is engaged with the stud 12*b* between the head 26*b* and a flange 60 secured on the stud 12*b*.

The only difference between the fastener system 10*b* shown in FIG. 5 and the fastener system 10*a* shown in FIGS. 2 and 4 is that instead of including an outwardly extending stake 56 which is integral and unitary with the stud for retaining the flange 60 thereon, the stud 12*b* of fastener system 10*b* includes an annular recess 88 or groove into which is swaged a collar 90. The collar 90 locks into the annular recess 88 and retains the flange 60 against an outwardly extending shoulder 92 on the stud 12*b*.

To assemble the fastener system 10*b* shown in FIG. 5, the flange 60 is first brought past the end 14*b* of the stud 12*b* , along the extending portion 18*b* and into contacting engagement with the outwardly extending shoulder 92 on the stud 12*b*. Then, the collar 90 is brought past the end 14*b* of the stud 12*b* , along the extending portion 18*b* and into locking engagement with the annular recess 88 on the stud 12*b*. As a result, the flange 60 becomes secured to the stud 12*b* between the outwardly extending shoulder 92 and the collar 90. The remaining steps of assembly are identical to those of fastener system 10*a* (e.g. the expander actuator member 80 is brought past the end 16*b* of the stud 12*b* into contact with the flange 60 and then the expander 38 is brought past the end 16*b* of the stud 12*b* into initial contact with the expander actuator member 80. Finally, the head 26*b* is formed on the end 16*b* of the stud 12*b*). After assembly, the fastener system 10*b* can be secured to a workpiece 68 in much the same manner as described above with respect to the other fastener systems 10 and 10*a*. When the fastener system 10*b* is secured to the workpiece 68, the flange 60 flexes between the collar 90 and the outwardly extending shoulder 92 on the stud 12*b* to urge the fastener system 10*b* out from the receptacle 66 of the workpiece 68.

Like the other fastener systems 10 and 10*a,* fastener system 10*b* is comprised of very few components and provides an integral assembly which does not readily disassemble and which resists accidental release from a workpiece after being engaged therewith.

The fastener system 10*c* shown in FIG. 6 is similar to those fastener system 10, 10*a* and 10*b* which have already been described. Therefore, identical reference numerals are used to identify identical parts, and detailed description thereof is omitted with the understanding that one can refer to the description of the previously-described fastener systems to obtain an understanding of the corresponding part of fastener system 10*c*. Additionally, where parts of the fastener system 10*c* are very similar to certain parts of the other fastener systems, identical reference numerals are used with the alphabetic suffix "c" added.

The fastener system 10*c* shown in FIG. 6 includes a stud 12*c* having a head 26*c* at an end 16*c*. The head 26*c* retains an expander 38 and an expander actuator member 80 on the stud 12*c*. At the other end 14*c* of the stud 12*c* is a head 94 and the head 94 retains a flange 60 against an outwardly extending shoulder 92*c* on the stud 12*c*. The expander 38 and expander actuator member 80 are retained on the stud 12*c* between the head 26*c* at the one end 16*c* of the stud 12*c* and the flange 60 retained by the head 94 at the other end 14*c* of the stud 12*c*. Overmolded onto the head 94 and flange 60 is a plastic pad 96. Preferably, the plastic pad 96 has an extending portion 98 which can provide traction with a ground as was described with relation to the extending portion 18 of fastener system 10. Also, preferably the pad 96 covers the head 94 and external surface 100 of the flange 60 and wraps around the edge 102 of the flange 60 extending to the other side 104 of the flange 60. This provides that the pad 96 does not readily separate from the flange 60 or head 94. Of course, other configurations of the pad 96 may be utilized.

The fastener system 10*c* shown in FIG. 6 can be assembled as follows. First, the stud 12*c* is formed such that the stud 12*c* initially includes its threaded portion 20*c* and its outwardly extending shoulder 92*c*, but does not include either head 26*c* or 94. Then, the flange 60 is brought past the end 14*c* of the stud 12*c* into contact with the shoulder 92*c* of the stud 12*c*. Then, the expander actuator member 80 is brought over the end 16*c* of the stud 12*c* into contact with the flange 60, and the expander 38 is brought over the end 16*c* of the stud 12*c* into contact with the expander actuator member 80. After this is done, the heads 26*c* and 94 can be formed on the stud 12*c* in the same manner as described above in relation to fastener system 10. Finally, the pad 96 can be molded onto the flange 60 and the head 94. After the fastener system 10*c* is assembled, it can be secured to a workpiece 68 in much the same manner as fastener system 10*a*.

The fastener system 10*c* shown in FIG. 6 presents the same advantages as those which have been already described. For example, the fastener system 10*c* includes very few components, can be provided in an integral assembly, and resists accidental disengagement from a workpiece.

It should be apparent that alternatives to the embodiment shown in FIG. 6 are readily available in accordance with the present invention. For example, an integral ramp can be provided as a portion of the stud 12*c* instead of utilizing a separate expander actuator member 80. Additionally, a retainer can be used on the stud 12*c* between the head 26*c* and the expander 38.

While several embodiments of the present invention are shown and described, it is envisioned that those skilled in the art may devise various modifications and equivalents without departing from the spirit and scope of the invention as defined by the appended claims. The invention is not intended to be limited by the foregoing disclosure.

The invention claimed is:

1. A fastener system comprising:

a shaft having an expander retaining structure and a threaded portion thereon;

an expander configured for disposition and engagement in a receptacle at least partially defined by a surface, said expander having a wall defining a bore, said expander having an end for receiving at least said threaded portion of said shaft in said bore, at least a portion of said wall of said expander being threaded for receiving said threaded portion of said shaft, said expander retaining structure on said shaft retaining said expander thereon when said threaded portion of said shaft is received by said expander;

expander actuating structure on at least one of said shaft and on said expander for actuating said expander causing said expander to engage with said surface; and a flange surroundingly securing said shaft for axially biasing said fastener along an axis generally coaxial with a longitudinal axis of said shaft.

2. A fastener system as recited in claim 1, wherein said flange is captively retained against said shaft by an annular rim on said shaft.

3. A fastener system comprising:

a shaft having an expander retaining structure and a threaded portion thereon;

an expander configured for disposition and engagement in a receptacle at least partially defined by a surface, said expander having a wall defining a bore, said expander having an end for receiving at least said threaded portion of said shaft in said bore, at least a portion of said wall of said expander being threaded for receiving said threaded portion of said shaft, said expander retaining structure on said shaft retaining said expander thereon when said threader portion of said shaft is received by said expander, said expander retaining structure comprising a head on an end of said shaft adjacent said threaded portion thereof, said head contacting said end of said expander;

expander actuating structure on at least one of said shaft and on said expander for actuating said expander causing said expander to engage with said surface; and a flange surroundingly securing said shaft for axially biasing said fastener along a longitudinal axis generally coaxial with an axis of elongation of said shaft; a ring between said expander and said flange, said expander retained between said head at said end of said shaft and said ring, said flange engaged against said ring thereby causing said ring to press against said expander, said pressing further causing said expander to expand against said surface.

4. A fastener system as recited in claim 3, wherein said flange is captively retained against said shaft between an annular rim on said shaft and an outwardly extending collar on said shaft.

5. A fastener system as recited in claim 3, wherein said flange is retained between an annular rim on said shaft and a collar lockingly swaged into said shaft.

6. A fastener system as recited in claim 5, wherein collar is lockingly swaged into an annular groove on said shaft.

7. A fastener system as recited in claim 4, wherein said annular rim is at an end of said shaft, and wherein said end of said shaft and said flange are overmolded by a pad.

8. A fastener system comprising:

a shaft having an expander retaining structure and a threaded portion thereon;

an expander configured for disposition and engagement in a receptacle at least partially defined by a surface, said expander having a wall defining a bore, said expander having an end for receiving at least said threaded portion of said shaft in said bore, at least a portion of said wall of said expander being threaded for receiving said threaded portion of said shaft, said expander retaining structure on said shaft retaining said expander thereon when said threader portion of said shaft is received by said expander;

expander actuating structure on at least one of said shaft and on said expander for actuating said expander causing said expander to engage with said surface, said expander retaining structure comprising a head at an end of said shaft adjacent said threaded portion thereof, said shaft having another head at a second, opposite end thereof overmolded by a pad, said expander spreading structure comprising a expander engaging ramp on said shaft, said fastener system further comprising a retainer between said head at said end of said shaft and said expander, said expander retained between said retainer and said expander engaging ramp on said shaft, said expander engaging ramp engaged against said expander thereby causing said expander to expand against said surface.

9. A fastener system comprising:

a shaft having an expander retaining structure and a threaded portion thereon;

an expander threadably engaged with said threaded portion of said shaft and configured for disposition and engagement in a receptacle at least partially defined by a surface, said expander having an internal wall defining a threaded bore receiving said threaded portion of said shaft, said expander retaining on said shaft retaining said expander thereon when said threaded portion of said shaft is received by said threaded bore of said expander, said expander engaging said surface upon rotation of said shaft after said expander and said shaft engaged therewith have been received by said receptacle, said expander retaining structure comprising a head at an end of said shaft adjacent said threaded portion thereof, said fastener system further comprising a ring between said expander and said flange, said expander retained between said head at said end of said shaft and said ring, said flange engaged against said ring thereby causing said ring to press against said expander, said pressing causing said expander to expand against said surface.

10. A fastener system as recited in claim 9, said expander retaining structure comprising a head at an end of said shaft adjacent said threaded portion thereof, said fastener system further comprising an expander engaging ramp on said shaft; a retainer between said head at said end of said shaft and said expander, said expander retained between said retainer and said expander engaging ramp on said shaft of said fastener, said expander engaging ramp engaged against said expander thereby causing said expander to expand against said surface.

11. A fastener system as recited in claim 9, further comprising a flange captively retained against said shaft between an annular rim on said shaft and an outwardly extending collar on said shaft.

* * * * *

UNITED STATES PATENT AND TRADEMARK OFFICE

CERTIFICATE OF CORRECTION

PATENT NO. : 5,938,384
DATED : August 17, 1999
INVENTOR(S) : John D. Pratt

It is certified that error appears in the above-identified patent and that said Letters Patent is hereby corrected as shown below:

Column 10, Line 64 "threader" should be -- threaded --

Signed and Sealed this

Thirtieth Day of May, 2000

*Attest:*

*Attesting Officer*

Q. TODD DICKINSON

*Director of Patents and Trademarks*